US006932075B1

(12) United States Patent
Tsao

(10) Patent No.: US 6,932,075 B1
(45) Date of Patent: Aug. 23, 2005

(54) BLADE ANGLE ADJUSTMENT DEVICE FOR A STONE CUTTER

(76) Inventor: Wen-Hai Tsao, P.O. Box 697, Feng-Yuan City, Taichung Hsien (TW) 420

( * ) Notice: Subject to any disclaimer, the term of this patent is extended or adjusted under 35 U.S.C. 154(b) by 46 days.

(21) Appl. No.: 10/744,013

(22) Filed: Dec. 24, 2003

(51) Int. Cl.[7] ..... B28D 1/04
(52) U.S. Cl. ..... 125/13.01; 125/13.03; 83/581
(58) Field of Search ..... 125/13.01, 13.03; 83/581, 171, 435.11, 477.1, 477.2

(56) References Cited

U.S. PATENT DOCUMENTS 3,727,502 A * 4/1973 Steinman ..... 83/471.3
4,211,134 A * 7/1980 Thorsell et al. ..... 83/471.3
4,428,159 A * 1/1984 Sigetich et al. ..... 451/213
6,080,041 A * 6/2000 Greenland ..... 451/11
6,272,961 B1 * 8/2001 Lee ..... 83/581
6,276,990 B1 * 8/2001 Greenland ..... 451/11
2004/0134324 A1 * 7/2004 Sheddy et al. ..... 83/581
2004/0149107 A1 * 8/2004 Lee ..... 83/581

* cited by examiner

*Primary Examiner*—M. Rachuba

(57) ABSTRACT

A blade angle adjustment device for a stone cutter includes a framed base having a working table slidably disposed on the base including a vertical cutting groove and a slant cutting groove in upper surface, a tool plate and a support arm respectively secured to a lateral side thereof, a L-shaped link having pair of screw holes in a longitudinal portion engaged with a screw hole and oblong hole on the top of the support arm and secured by a screw and a first swivel lock, a screw hole and an arcuate slot in a transverse portion respectively engaged with the front ends of a large and a small internally threaded large and small connection rods and secured by a second swivel lock and a handled screw, a motor protected by an upper housing and a lower housing which is connected to the rear end of the connection rods and a guarded circular blade connected to an axis of the motor so that slides the first swivel lock in the oblong hole to define the elevational angle for the cutting mechanism and slides the small connection rod to define the slant angle for the blade up to 45 degree.

1 Claim, 8 Drawing Sheets

BLADE ANGLE ADJUSTMENT DEVICE FOR A STONE CUTTER

BACKGROUND OF THE INVENTION

The present invention relates to stone cutters and more particularly to a blade angle adjustment device for a stone cutter.

A portable stone cutter facilitates the brick layers to cut the tiles or stones in order to fit the working site. The blade of prior art stone cutter is generally positioned perpendicular to cutting table such that the tiles or stones being cut appear a straight plane edge which is not fitting with one another at a corner of the wall. Thus, the tiles or stones must be cut a slant edge in predetermined angle to meet the requirement of close connection.

Although, a blade angle adjustment device for the stone cutter appears in the market enabling to cut different slant edges for the tiles. But it is difficult to operate and the results are not so ideal. Further, the adjustment of different slant angle for the blade is usually not accurate and the slant angles of the tile edges are not so uniform.

SUMMARY OF THE PRESENT INVENTION

The present invention has a main object to provide a blade angle adjustment device for a stone cutter, which the blade angle is rapidly adjusted and/or backs to its original position. The blade is adjusted into a single accurate slant angle and the operation of the angle adjustment is very convenient to do.

Accordingly, the blade angle adjustment device for a stone cutter of the present invention comprises generally a framed base having a working table slidably disposed on the base including a vertical cutting groove and a slant cutting groove in the surface, a support arm connected to an outmost bar of the base including a screw hole and a oblong hole in the top, a L-shaped link having a pair of screw holes in a longitudinal portion respectively engaged with the screw hole and the oblong hole of the support arm and fastened by a screw and a swivel lock and a through hole and an arcuate slot in a transverse portion for connecting with a cutting mechanism which has a motor protected by an upper and lower housings a guarded circular blade connected to an axis of the motor, a swivel lock and a handled screw respectively connected with upper housing through the screw hole and the arcuate slot of the link and a pair of internally threaded rods in order to fix and to adjust the slant angle of the circular blade.

The present invention will become more fully understood by reference to the following detailed description thereof when read in conjunction with the attached drawings.

DETAILED DESCRIPTION OF THE PREFERRED EMBODIMENT

Figure 1:
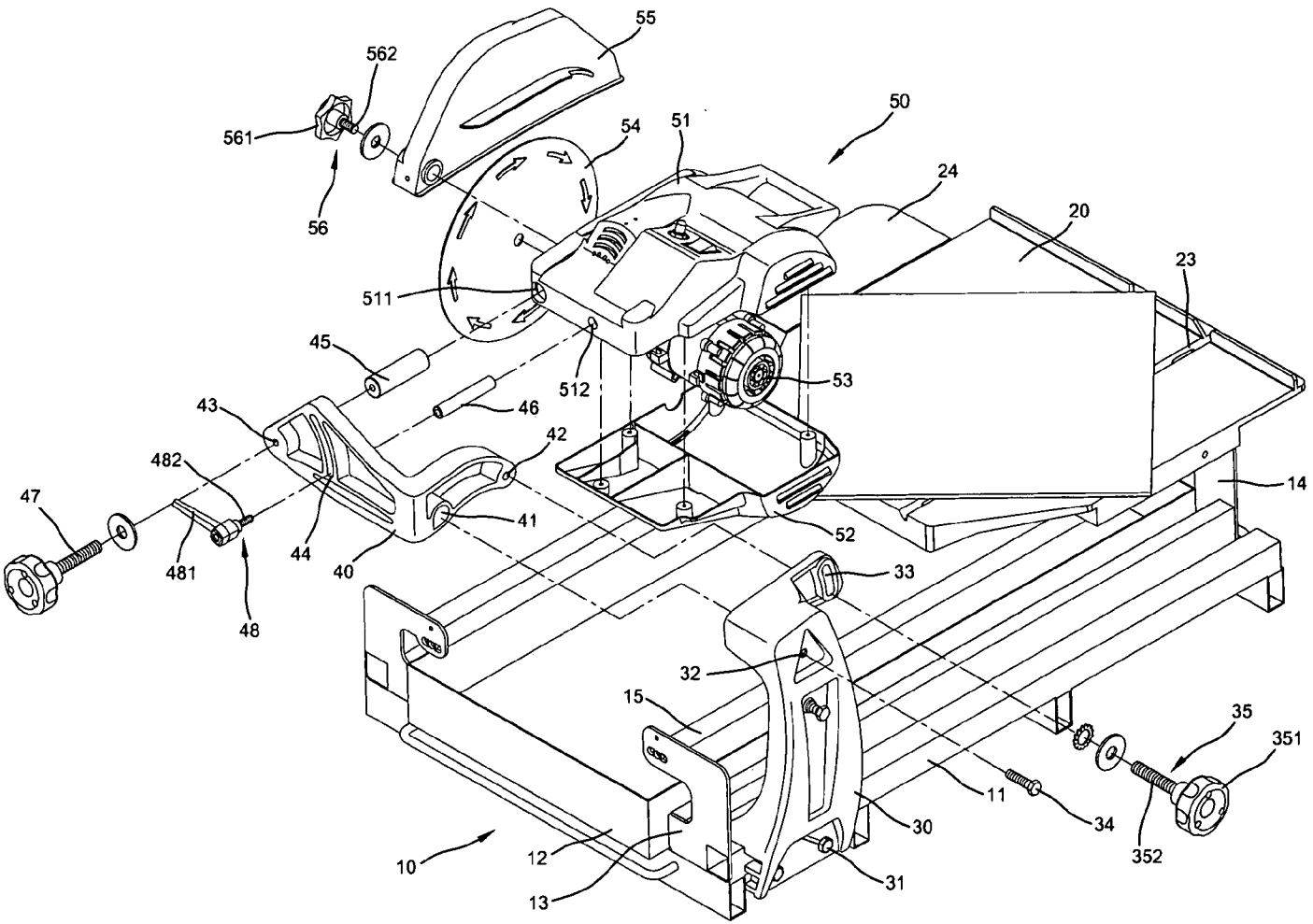
FIG. 1 is an exploded perspective of the stone cutter of the preferred embodiment of the present invention.
Figure 2:
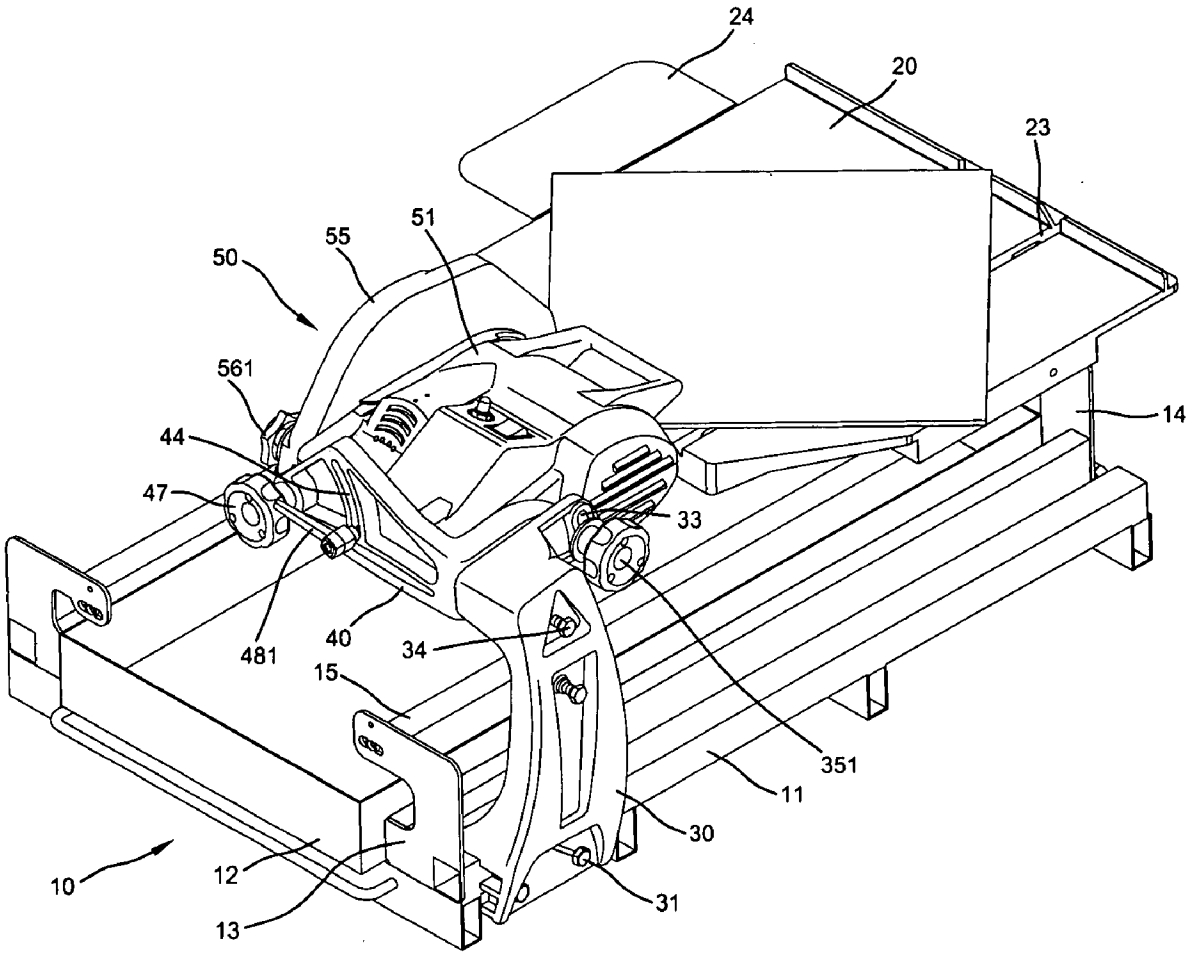
FIG. 2 is a perspective view to show the assembly of the stone cutter of the present invention.
Figure 3:
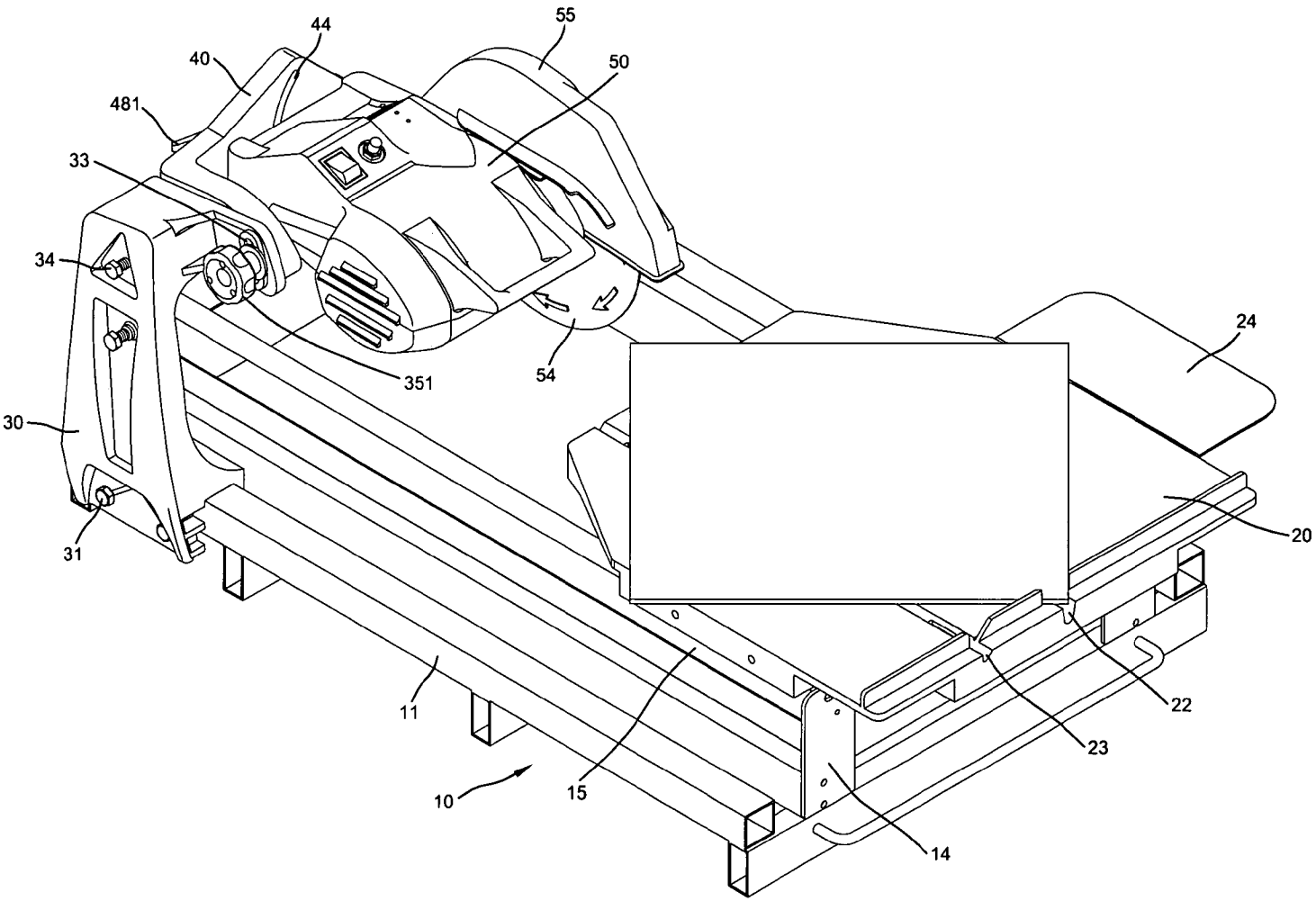
FIG. 3 is a perspective view of FIG. 2 looking at different angle.
Figure 4:
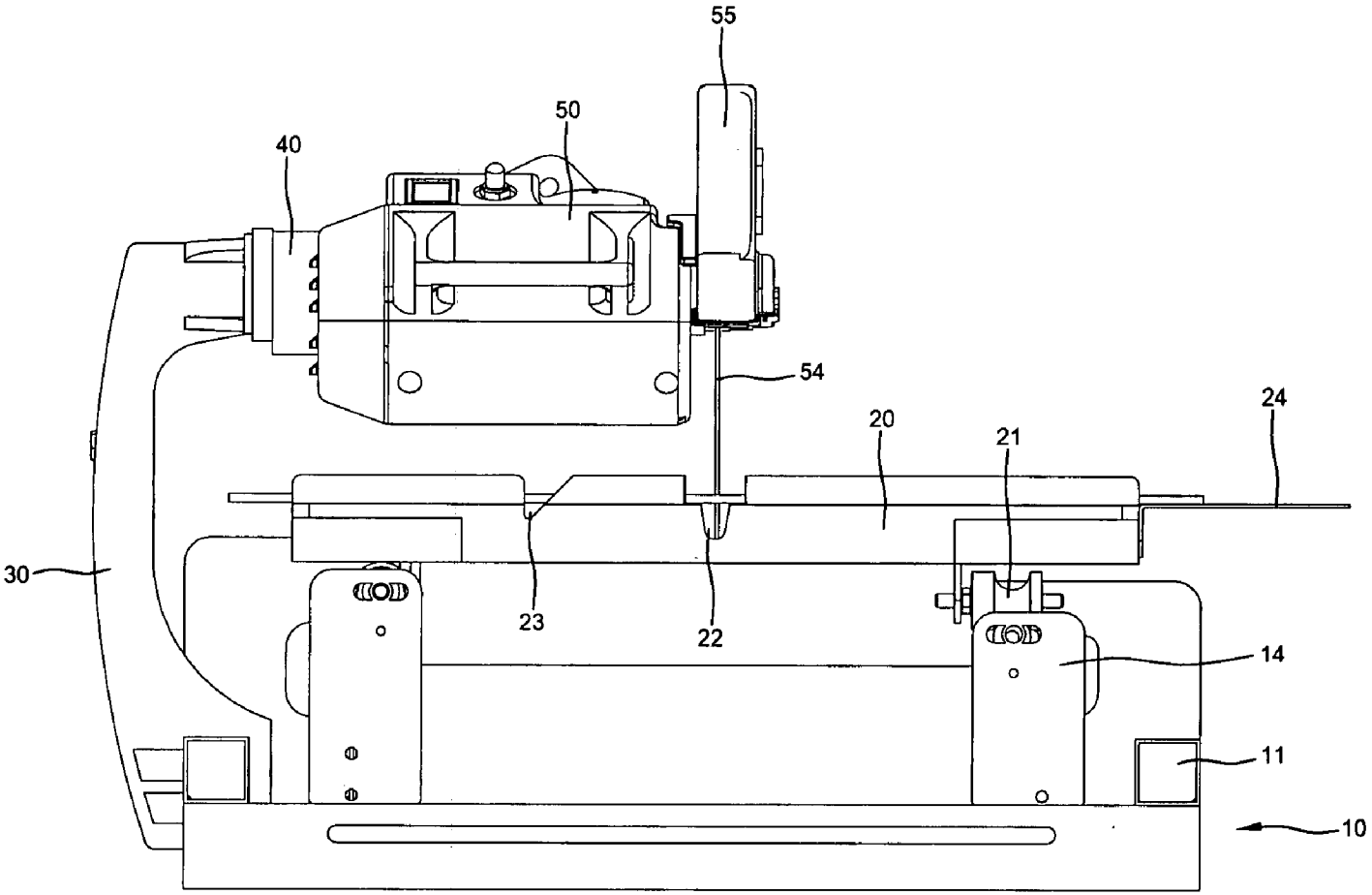
FIG. 4 is a plane view looking from rear side.

With reference to FIGS. 1 to 4 of the drawings, the blade angle adjustment device for a stone cutter of the present invention comprises a framed base 10 having a pair of outmost longitudinal bars 11, a rectangular frame 12, a pair of first sustaining plates 13 at front corners, a pair of second sustaining plates 14 at rear corners for supporting a pair of guide bars 15 respectively, a working table 20 having a plurality of rollers 21 on underside slidably disposed on the pair of guide bars 15, a vertical cutting groove 22 and slant cutting groove 23 spacedly formed in the upper surface, a tool plate 24 disposed on a right side of the base 10, a support arm 30 connected to a front portion of an outmost longitudinal bar 11 on left side of the base 10 by a screw 31 and having a screw hole 32 in a triangular depression and an oblong hole 33 in an lateral extension on the upper portion thereof, a roughly L-shaped link 40 having a pair screw holes 41 and 42 spacedly formed in a longitudinal portion thereof respectively engaged with the screw hole 32 and oblong hole 33 and fastened by a screw 34 and a swivel lock 35 which has a threaded shank 352 inserted through the oblong hole 33 and screwed into the screw hole 42 with washers engaged therebetween and swivel knob 351 on outer end so that the L-shaped link 40 is centered on the screw 34 and vertically adjusted by the swivel lock, a cutting mechanism 50 having motor 53 protected by an upper housing 51 and lower housing 52, a circular blade 54 perpendicularly connected to an axis of the motor 53 and protected on the top by a guard 55 which is adjustably secured to a right side of the upper housing 51 by a swivel lock 56 which includes a threaded shank 562 and a swivel knob 561, wherein the upper housing 51 has large through hole 511 and a small through hole 512 spacedly formed in front side for respectively engaging with a large connection rod 45 and a small connection rod 46 both of which have inner threads. The free end of the large connection rod 45 engages with the through hole 43 in the transverse portion of the L-shaped link 40 and fastened by a swivel lock 47 with a washer engaged therebetween. The free end of the small connection rod 46 engages with the arcuate slot 44 of the L-shaped link 40 and fastened by a handle screw 48 which has a threaded shank 482 a lateral handle 481.

Figure 5:
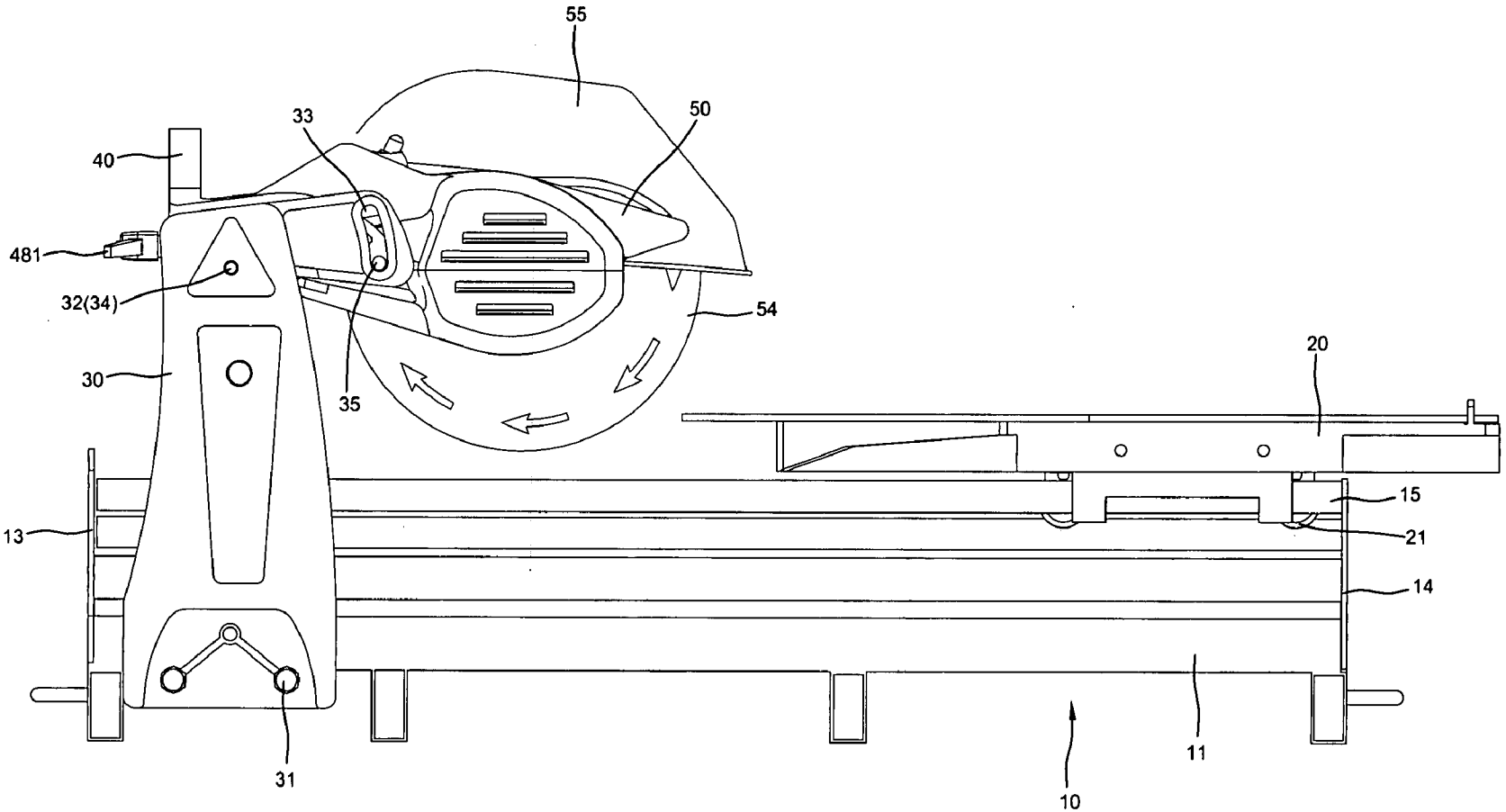
FIG. 5 is a plane view looking at left side.
Figure 6:
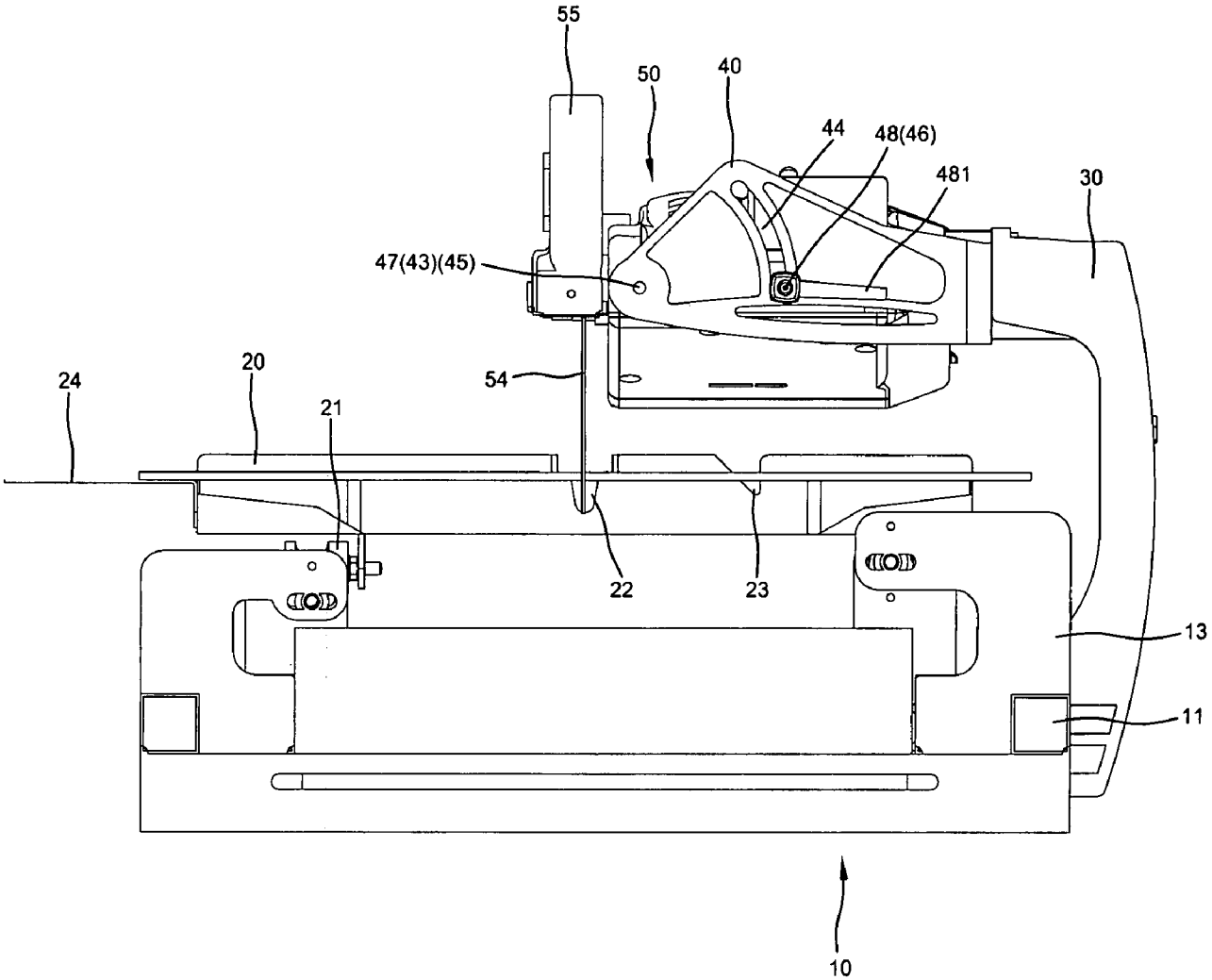
FIG. 6 is a plane view looking at front side while the blade is at a vertical position.

Referring to FIGS. 5 and 6 in operation, first adjust the elevational angle for the cutting mechanism 50 by unfastening and sliding the swivel locking 35 vertically in the oblong hole 33 and fasten the swivel look 35 again after a proper elevational angle of the cutting mechanism 50 is found out. Then fasten the handle screw 48 in the lower end of the arcuate slot 44 while the blade 54 is at a complete vertical portion and engages within the vertical cutting groove 22 of the working table 20 and then put a working piece on the top of the working table 20 which is slid forward on base 10 to perform a normal cutting that the edge of the working piece will be exactly straight and plane.

Figure 7:
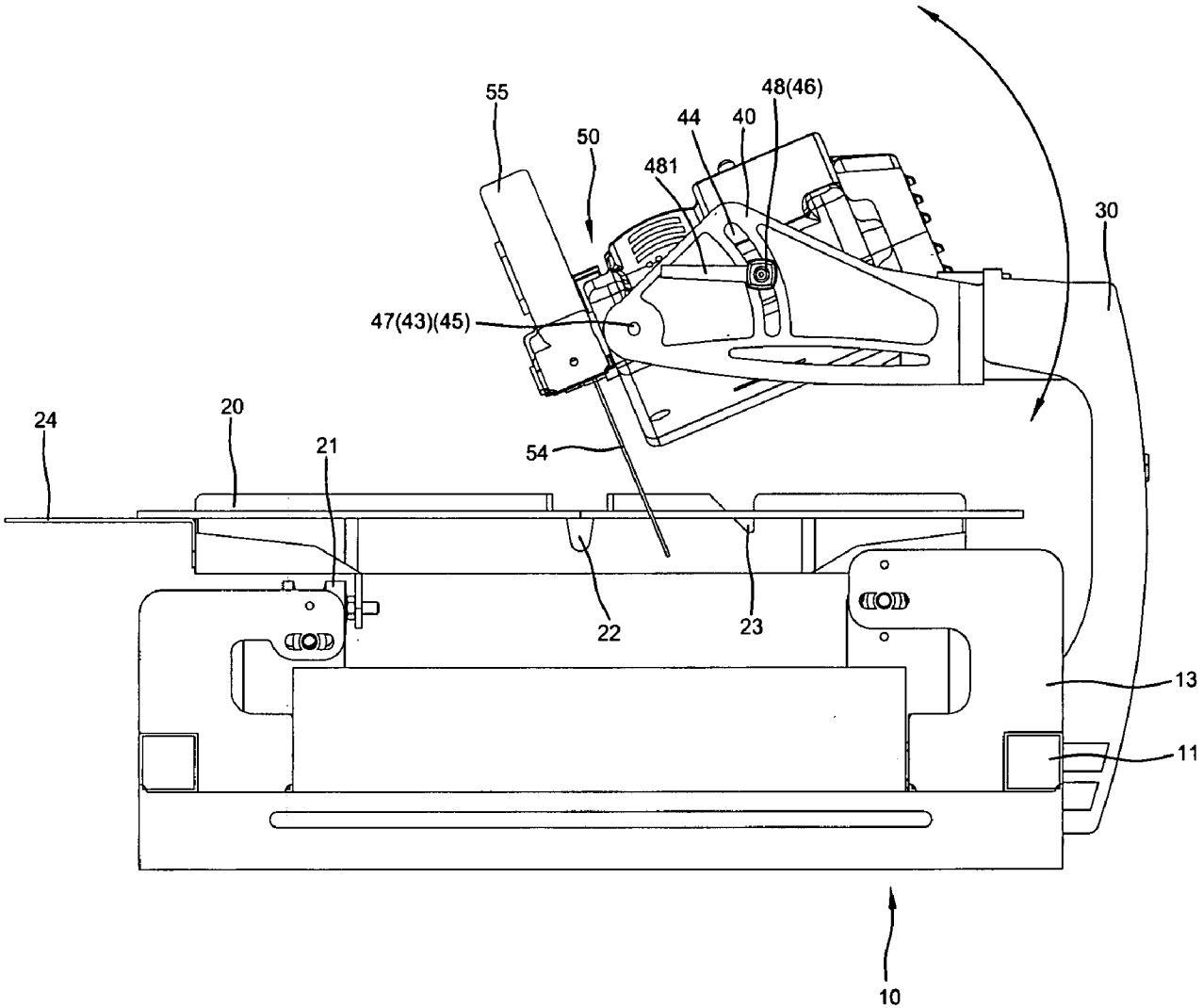
FIG. 7 is a plane view of FIG. 6 while the blade is being adjusted to a slant angle.
Figure 8:
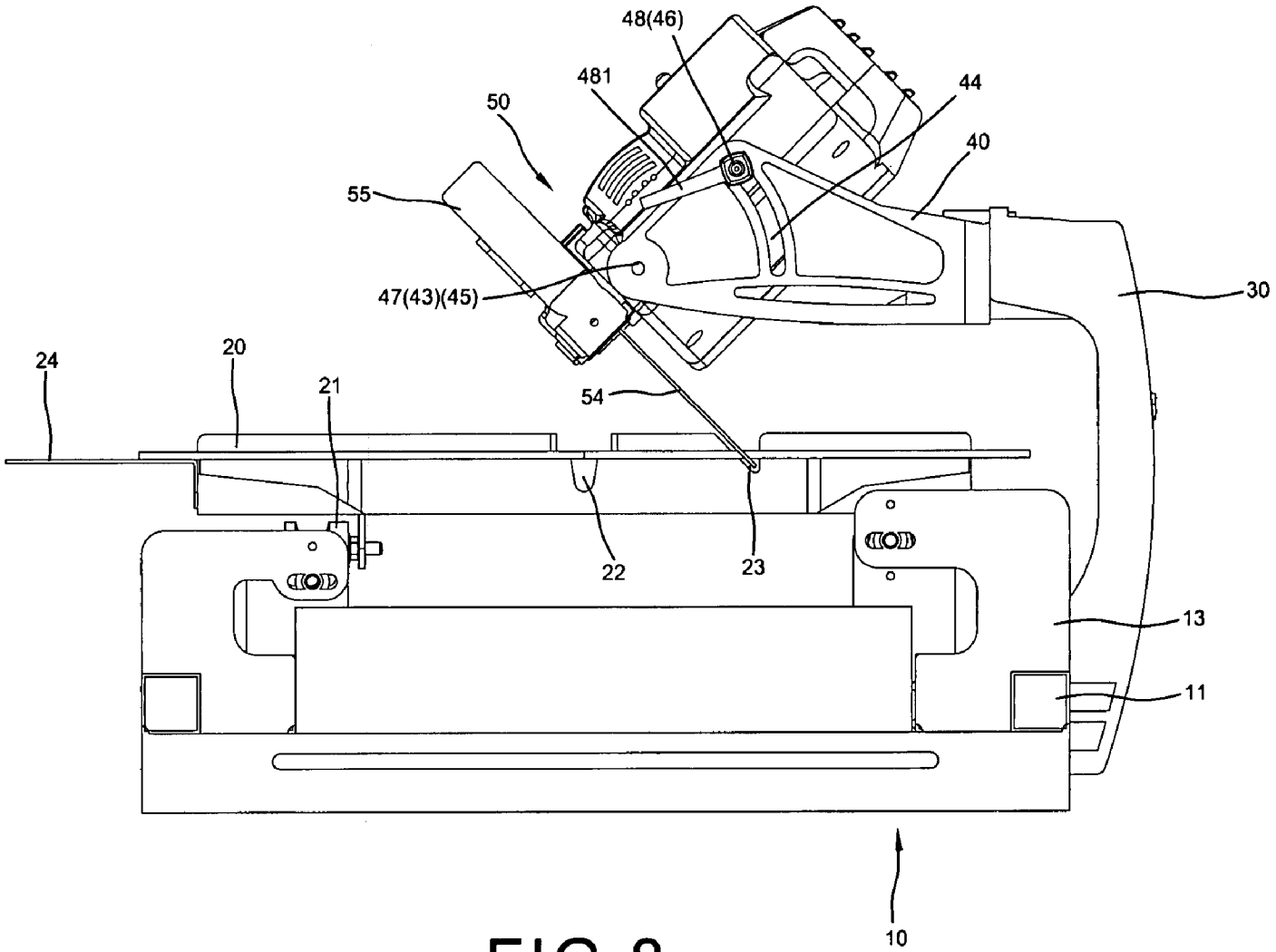
FIG. 8 is a plane view of FIG. 6 while the blade is adjusted to 45° angle relative to the upper surface of the working table and engaged within a slant cutting groove.

Referring to FIGS. 7 and 8, when cut a slant edge for the working pieces, simultaneously unfasten the swivel lock 47 and the handled screw 48 and the slide the handled screw 48 in concert with small connection rod 46 upward centered on the large connection rod 45. Then fasten both the swivel lock 47 and the handled screw 48 again until that the small connection rod 46 reaches to the upper end of the arcuate slot 44. The cutting mechanism 50 is already slanted and the plane of the circular blade 54 forms a 45° slant angle relative to the upper surface of the working table 20 and the edge of the blade 54 is partially engaged within the slant cutting groove 25 of the working table 20 so that edge of the working pieces is cut into a slant angle of 45°. When the job is finished, unfasten both the swivel lock 47 and the handled screw 48, the small connection rod 46 together with the handled screw 48 are automatically drop down to the lower end of the arcuate slot 44 on the weight of the cutting mechanism 50. Then fasten both the swivel lock 47 and the handled screw 48, the cutting mechanism together with the circular blade 54 are therefore returned to their normal and vertical positions.

This arrangement provides a rapid, convenient and accurate angle adjustment process. Because the fastening means have not the loose problem, the working results are uniform in good quality.

Note that the specification relating to the above embodiment should be construed as an exemplary rather than as a limitative of the present invention, with many variations and modifications being readily attainable by a person of average skill in the art without departing from the spirit or scope thereof as defined by the appended claims and their legal equivalents.

I claim:

1. A blade angle adjustment device for a stone cutter comprising:

a framed base composed of a plurality of longitudinal bars, a plurality of transverse bars, a pair of outmost longitudinal bars and a pair of guide bars spaced longitudinally, two pairs of supports on plates at two ends of the base and a tool plate at a right side of said base;

a support arm having a lower portion connected to the front portion of an outmost bar on a right side of said base by screws, a first screw hole in a triangular depression and an oblong hole in a lateral extension on upper portion thereof;

a working table having a plurality of rollers spacedly disposed on underside and slidably disposed on said guide bars of said base, a vertical cutting groove and a slant cutting groove spacedly formed in a upper surface thereof;

a L-shaped link having a longitudinal portion, a transverse portion, a pair of second screw holes spacedly formed in the longitudinal portion respectively engaged with the first screw hole and the oblong hole of said support arm and respectively secured by a screw and a first swivel lock which has a threaded shank inserted through the oblong hole and screwed with a second screw hole and a swivel knob on outer end thereof, a third screw hole and an arcuate slot spacedly formed in the transverse portion thereof and a pair of internally threaded large and small connection rods having their front ends respectively engaged with the third screw hole and the arcuate slot and secured by a second swivel lock and handled screw;

a cutting mechanism having a motor protected by an upper housing and lower housing, a large through hole and small through hole spacedly formed in a front wall of said upper housing for respectively securing the rear ends of said large and small connection rods, a circular blade perpendicularly connected to an axis of said motor and protected by a guard on top, said guard being adjustably secured to a right wall of said upper housing by a third swivel lock which includes a threaded shank and swivel knob on outer end of the shank;

whereby, said first swivel lock vertically slides within said oblong hole, the elevational angle of said cutting mechanism is defined and fixed by said small connection rod in upper end of said arcuate slot, to define a 45° slant angle of said circular blade.

* * * * *